US011521814B2

(12) United States Patent
Erven

(10) Patent No.: US 11,521,814 B2
(45) Date of Patent: Dec. 6, 2022

(54) LOW-VOLTAGE CIRCUIT BREAKER

(71) Applicant: Siemens Aktiengesellschaft, Munich (DE)

(72) Inventor: Wolfgang Erven, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/279,176

(22) PCT Filed: Sep. 27, 2018

(86) PCT No.: PCT/EP2018/076268
§ 371 (c)(1),
(2) Date: Mar. 24, 2021

(87) PCT Pub. No.: WO2020/064109
PCT Pub. Date: Apr. 2, 2020

(65) Prior Publication Data

US 2022/0005659 A1 Jan. 6, 2022

(51) Int. Cl.
*H01H 1/02* (2006.01)
*H01H 9/54* (2006.01)
(Continued)

(52) U.S. Cl.
CPC ..... *H01H 33/666* (2013.01); *H01H 1/0203* (2013.01); *H01H 9/542* (2013.01);
(Continued)

(58) Field of Classification Search
CPC ..... H01H 33/666; H01H 33/6661; H01H 33/6662; H01H 1/0203; H01H 9/542;
(Continued)

(56) References Cited

U.S. PATENT DOCUMENTS 5,650,901 A 7/1997 Yamamoto
7,763,874 B2 * 7/2010 Noguchi ..... H01H 9/542 250/551
(Continued)

FOREIGN PATENT DOCUMENTS

DE 19601540 A1 11/1996
DE 10340003 A1 4/2005
(Continued)

OTHER PUBLICATIONS http://www.inigrid.at/Intermediate-Results/; 2021.
(Continued)

*Primary Examiner* — William A Bolton
(74) *Attorney, Agent, or Firm* — Harness, Dickey & Pierce, P.L.C.

(57) ABSTRACT

A low-voltage circuit breaker includes at least one current sensor for determining the magnitude of the electric current of a conductor of the low-voltage circuit breaker; and at least one electromechanical switching unit for connecting and disconnecting at least two electrical contact points. In a first switching position of the movable contact point, two contact points are connected and in a second switching position the contact points are not connected to one another. The circuit breaker further includes at least one electronic switching unit having a semiconductor switching element, electrically conductive in a first switching state and electrically blocking in a second switching state; an electronic tripping unit, connected to the current sensor, the electronic switching unit and the electromechanical switching unit. Further, when current and/or current/time-period limit values of the conductor are exceeded, first the electromechanical switching unit is opened and then the electronic switching unit is blocked.

8 Claims, 2 Drawing Sheets

(51) Int. Cl.
*H01H 33/666* (2006.01)
*H01H 71/12* (2006.01)

(52) U.S. Cl.
CPC ..... *H01H 9/548* (2013.01); *H01H 71/127* (2013.01); *H01H 2009/544* (2013.01)

(58) Field of Classification Search
CPC ..... H01H 9/548; H01H 2009/544; H01H 71/127; H01H 57/00; H01H 9/541; H01H 9/547; H01H 2009/546
USPC ..... 218/118
See application file for complete search history.

(56) References Cited

U.S. PATENT DOCUMENTS 7,817,382 B2 * 10/2010 Yu ..... H01H 9/542 361/13
8,503,138 B2 * 8/2013 Demetriades ..... H01H 9/542 361/11
9,178,348 B2 * 11/2015 Gaxiola ..... H02H 9/02
2002/0093778 A1 * 7/2002 Meckler ..... H01H 83/12 361/160
2010/0302700 A1 * 12/2010 Kellis ..... H02H 3/0935 361/109
2014/0299579 A1 * 10/2014 Hartmann ..... H02H 3/087 361/93.1
2015/0222111 A1 * 8/2015 Magnusson ..... H01H 33/165 361/91.5
2019/0198271 A1 * 6/2019 Muir ..... H01H 33/28

FOREIGN PATENT DOCUMENTS

DE 102008030095 A1 1/2010
GB 2375902 A 11/2002
GB 2550155 A 11/2017
JP H04289623 A 10/1992

OTHER PUBLICATIONS

Jendritza D.J., "Technischer Einsatz neuer Aktoren", Band 484, Expert Verlag 1995, S. 224, ISBN 3-8169-1235-4 TIP-RA4189 BAM-E-0191/96, Buchkapitel, Design und Anwendung von Piezoaktoren; 1995.
PCT International Search Report and Written Opinion of International Searching Authority dated Apr. 1, 2019 corresponding to PCT International Application No. PCT/EP2018/076268 filed Sep. 27, 2018.

* cited by examiner

LOW-VOLTAGE CIRCUIT BREAKER

PRIORITY STATEMENT

This application is the national phase under 35 U.S.C. § 371 of PCT International Application No. PCT/EP2018/076268 which has an International filing date of Sep. 27 2018, which designated the United States of America, the entire contents of which are hereby incorporated herein by reference.

FIELD

At least some example embodiments of the invention generally relate to a low-voltage circuit breaker for a low-voltage circuit and to a low-voltage switch for a low-voltage circuit.

BACKGROUND

Circuit breakers are protective devices which act similarly to a fuse. Circuit breakers monitor the current flowing through them via a conductor and interrupt the electrical current or energy flow to an energy sink or a consumer, which is referred to as tripping, when protective parameters, such as current limit values or current/time span limit values, i.e. when a current value is present for a certain time span, are exceeded. The set current limit values or current/time span limit values are corresponding grounds for tripping. Generally, the interruption takes place via mechanical contacts of the circuit breaker which are opened.

In particular for low-voltage circuits, installations or grids, there are various types of circuit breakers depending on the level of the provided electrical current in the electrical circuit. Within the meaning of the invention, circuit breaker is used to mean in particular switches such as are used in low-voltage installations for currents, in particular rated currents or maximum currents, of 63 to 6300 amperes. More specifically, closed circuit breakers are used for currents of 63 to 1600 amperes, in particular of 125 to 630 or 1200 amperes. Open circuit breakers are used in particular for currents of 630 to 6300 amperes, more specifically of 1200 to 6300 amperes.

Circuit breakers, CB for short, are subdivided into open circuit breakers or air circuit breakers, ACB for short, and closed circuit breakers or molded case circuit breakers or compact circuit breakers, MCCB for short.

The term low voltage is used to mean voltages up to 1000 volts AC or 1500 volts DC. More specifically, the term low voltage is used to mean in particular voltages which are greater than the extra-low voltage with values of 50 volts AC or 120 volts DC.

SUMMARY

The term low-voltage switch within the meaning of embodiments of the invention is used to mean in particular switches such as are used for rated currents or maximum currents of up to 63 amperes, in particular of 6.3 amperes to 16 amperes or of 16 amperes to 63 amperes. In particular, low-voltage switches may be so-called miniature circuit breakers.

The term circuit breaker within the meaning of embodiments of the invention is used to mean in particular circuit breakers having an electronic trip unit, ETU for short, acting as control unit.

Recently, there are hybrid switching devices, which have a combination of power electronics and electromechanical contact system. Previous, specifically purely electromechanical, concepts have disadvantages and/or are unsuitable for electrical grids which are no longer determined by the short-circuit power of a transformer. The inventors discovered that the reasons for the non-suitability are that these grids are fed by converters in special "active frontends", which have very quick switching times which cannot be detected or cannot be switched off by known switching devices. The inventors discovered that the conventional protection algorithms and mechanical delay times of electromechanical or previously known hybrid switches or switch concepts are too slow. Fully electronic switches are quick, but the inventors have discovered that they disadvantageously have high power losses and high costs, in particular if semiconductors on the basis of SiC are used. In addition, these protective devices do not have any DC isolation, which is often required in accordance with the product standard.

Embodiments of the present invention reside in improving a low-voltage circuit breaker or low-voltage switch, in particular in providing a hybrid switch, which is suitable for grids in which quick disconnection times are required.

Embodiments are directed to a low-voltage circuit breaker or a low-voltage switch. In accordance with an embodiment of the invention, in a first variant, a low-voltage circuit breaker is proposed, having:

at least one current sensor, for determining the level of the electrical current through a conductor, associated with the current sensor, of the low-voltage circuit breaker, wherein in each case one current sensor can be provided for each conductor or some of the conductors, at least one electromechanical switching unit for connecting and disconnecting at least two electrical contact points, of which at least one is movable in such a way that, in a first switching position of the movable contact point, two contact points are connected to one another and, in a second switching position, the relevant contact points are not connected to one another, wherein in each case one electromechanical switching unit can be provided for each conductor or some of the conductors, at least one electronic switching unit, which has a semiconductor switching element, is electrically conductive in a first switching state and electrically blocking in a second switching state, and is connected electrically in parallel with the electromechanical switching unit, wherein in each case one electronic switching unit can be provided for each conductor or some of the conductors, an electronic trip unit, which is connected to the current sensor, the electronic switching unit(s) and the electromechanical switching unit(s), and is configured in such a way that, when current or/and current/time span limit values of the conductor (or at least one conductor) are exceeded, first disconnection of the electromechanical switching unit and then blocking of the electronic switching unit takes place, in the case of a plurality of electromechanical and electronic switching units, this takes place at the same time for all corresponding switching units.

BRIEF DESCRIPTION OF THE DRAWINGS

The described properties, features and advantages of this invention and the way in which they are achieved will be become clearer and more easily understandable in connection with the following description of the example embodiments, which are explained in more detail in connection with the drawings.

In the associated drawings.

DETAILED DESCRIPTION OF THE EXAMPLE EMBODIMENTS

Figure 1:
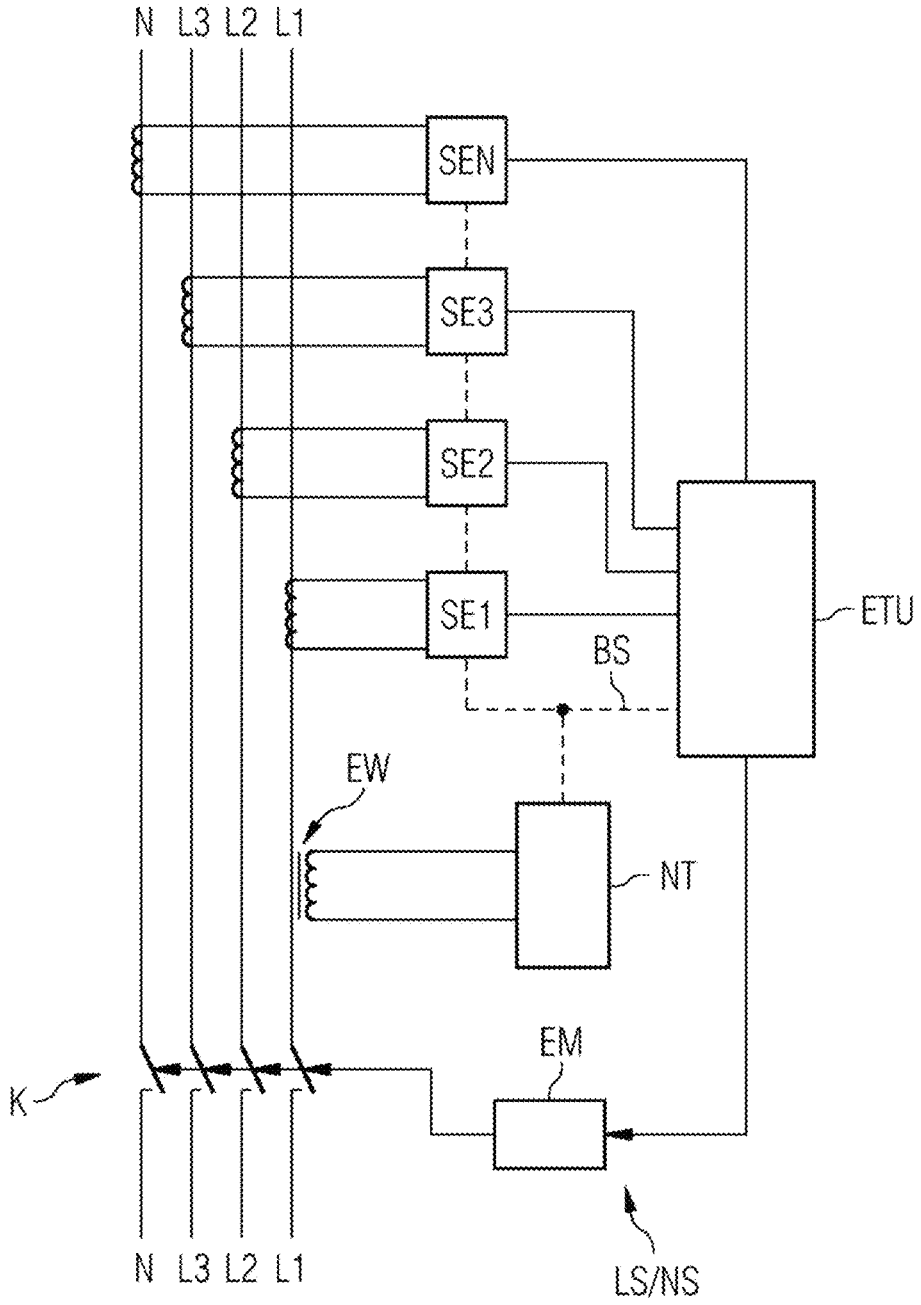
FIG. 1 shows a block circuit diagram of a low-voltage circuit breaker.

In accordance with an embodiment of the invention, in a first variant, a low-voltage circuit breaker is proposed, having:

at least one current sensor, for determining the level of the electrical current through a conductor, associated with the current sensor, of the low-voltage circuit breaker, wherein in each case one current sensor can be provided for each conductor or some of the conductors, at least one electromechanical switching unit for connecting and disconnecting at least two electrical contact points, of which at least one is movable in such a way that, in a first switching position of the movable contact point, two contact points are connected to one another and, in a second switching position, the relevant contact points are not connected to one another, wherein in each case one electromechanical switching unit can be provided for each conductor or some of the conductors, at least one electronic switching unit, which has a semiconductor switching element, is electrically conductive in a first switching state and electrically blocking in a second switching state, and is connected electrically in parallel with the electromechanical switching unit, wherein in each case one electronic switching unit can be provided for each conductor or some of the conductors, an electronic trip unit, which is connected to the current sensor, the electronic switching unit(s) and the electromechanical switching unit(s), and is configured in such a way that, when current or/and current/time span limit values of the conductor (or at least one conductor) are exceeded, first disconnection of the electromechanical switching unit and then blocking of the electronic switching unit takes place, in the case of a plurality of electromechanical and electronic switching units, this takes place at the same time for all corresponding switching units.

According to an embodiment of the invention, the electromechanical switching unit is configured as a vacuum circuit breaker, in which the contact points are in the vacuum, and a piezoelectric actuator is provided for the change in switching position (commutation) of the electromechanical switching unit.

According to an embodiment of the invention, in a second variant, a low-voltage switch is proposed, having:

at least one current sensor, for determining the level of the electrical current through a conductor, associated with the current sensor, of the low-voltage switch, wherein in each case one current sensor can be provided for each conductor or some of the conductors, at least one electromechanical switching unit for connecting and disconnecting at least two electrical contact points, of which at least one is movable in such a way that, in a first switching position of the movable contact point, two contact points are connected to one another and, in a second switching position, the relevant contact points are not connected to one another, wherein in each case one electromechanical switching unit can be provided for each conductor or some of the conductors, at least one electronic switching unit, which has a semiconductor switching element, is electrically conductive in a first switching state and electrically blocking in a second switching state, and is connected electrically in series with the electromechanical switching unit, wherein in each case one electronic switching unit can be provided for each conductor or some of the conductors, an electronic trip unit, which is connected to the current sensor, the electronic switching unit(s) and the electromechanical switching unit(s), and is configured in such a way that, when current or/and current/time span limit values of the conductor are exceeded, first blocking of the electronic switching unit and then disconnection of the electromechanical switching unit takes place, in the case of a plurality of electromechanical and electronic switching units, this takes place at the same time for all corresponding switching units.

According to an embodiment of the invention, the electromechanical switching unit is configured as a vacuum circuit breaker, in which the contact points are in the vacuum, and a piezoelectric actuator is provided for the change in switching position (commutation) of the electromechanical switching unit.

This has the particular advantage that a piezoelectric actuator is used for the commutation of the electrical current from the electromechanical switching unit or mechanical contact to the electronic switching unit or (power) semiconductor switching element or (power) semiconductor path. The piezoelectric actuator is so quick that a movement in approximately 20 μs or quicker is possible. It is thus possible to enable switchover to the parallel power semiconductor path in a time which makes it possible for the semiconductor which is now located in the current path to carry the current and to switch without the destruction limit of the semiconductor being reached. Therefore, very quick disconnections or interruptions of the electrical circuit can be achieved.

In addition, this has the particular advantage that a low-voltage switch is made possible, i.e. a switch for lower currents than in the case of the low-voltage circuit breaker, in which a series circuit of electromechanical switching unit and electronic switching unit is made possible, wherein the piezo-operated electromechanical switching unit takes over the task of the DC isolation.

In addition, at relatively low currents, only relatively low masses of the contacts or contact points need to be moved, wherein favorably piezoelectric actuators can be used.

Advantageous configurations of the invention are specified in the claims.

In an advantageous configuration of an embodiment of the invention, at least one electromechanical disconnecting unit is provided, which is arranged electrically in series with the parallel circuit comprising the vacuum circuit breaker/novel electromechanical switching unit and the electronic switching unit.

This has the particular advantage that DC isolation can be achieved.

In an advantageous configuration of an embodiment of the invention, the electromechanical disconnecting unit has disconnector properties. The term disconnector properties is used to mean a disconnection function in which a certain minimum spacing or minimum air gap between the contacts of the electromechanical disconnecting unit is realized. This minimum air gap is substantially voltage-dependent. Further parameters are the degree of contamination, the nature of the field (homogeneous, inhomogeneous), and the air pressure or the level above normal zero. There are corresponding regulations or standards for these minimum air gaps or leakage paths. These regulations specify, for example, in the case of air, for an impulse voltage withstand capability, the minimum air gap for an inhomogeneous and a homogeneous (ideal) electrical field depending on the degree of contamination. The impulse voltage withstand capability is the withstand capability on application of a corresponding impulse voltage. Only in the case of the presence of this minimum length (minimum gap) does the electromechanical disconnecting unit have a disconnection function or disconnector property. Within the meaning of the invention, in this case the series of standards DIN EN 60947 or IEC 60947, to which reference is made here, is relevant for the disconnection function and the properties thereof.

This has the particular advantage that the low-voltage circuit breaker has a disconnection function.

In an advantageous configuration of an embodiment of the invention, the electromechanical disconnecting unit is connected to the electronic trip unit, and, when current or/and current/time span limit values of the conductor are exceeded, first disconnection of the vacuum circuit breaker or of the novel electromechanical switching unit takes place, then blocking of the electronic switching unit, and then disconnection of the electromechanical disconnecting unit.

This has the particular advantage that the production of the disconnection function takes place automatically.

In an advantageous configuration of an embodiment of the invention, the piezoelectric actuator is a piezoelectric stack.

This has the particular advantage that a particularly simple and favorable realization for the piezoelectric actuator is provided, wherein large switching travels for the electromechanical switching unit can be realized by the piezoelectric stack.

In an advantageous configuration of an embodiment of the invention, the semiconductor switching element is a component based on silicon, in particular it is an IGBT, i.e. isolated gate bipolar transistor. The term based on silicon is in particular used to mean no component based on SiC (silicon carbide).

This has the particular advantage that a particularly cost-effective realization is provided.

In an advantageous configuration of an embodiment of the invention, the switch is provided for a low-voltage circuit, and a vacuum circuit breaker or a novel electromechanical and an electronic switching unit is provided for each conductor, which is monitored by the switch, of the low-voltage circuit.

This has the particular advantage that each monitored conductor of the low-voltage circuit is protected by a solution according to an embodiment of the invention. In a three-phase AC circuit, thus the three phase conductors and, when a neutral conductor is present, possibly the neutral conductor are protected. Therefore, three or four combinations of electromechaninal and electronic switching unit are provided. If appropriate, this is supplemented by three or four electromechanical disconnecting units. All of the configurations, both in dependent form and merely referred back to individual features or combinations of features of embodiments, bring about an improvement to a low-voltage circuit breaker or low-voltage switch, in particular for improving the switching times.

FIG. 1 shows a schematic block circuit diagram of a low-voltage circuit breaker LS or low-voltage switch NS of a conventional design. FIG. 1 shows electrical conductors L1, L2, L3, N of a low-voltage circuit, for example a three-phase AC circuit, wherein the first conductor L1 forms the first phase, the second conductor L2 forms the second phase, the third conductor L3 forms the third phase, and the fourth conductor forms the neutral conductor N of the three-phase AC circuit. The conductors are passed through the low-voltage circuit breaker LS or low-voltage switch NS. The low-voltage circuit breaker LS or low-voltage switch NS is in particular arranged in a housing.

In the example shown in FIG. 1, the first conductor L1 is connected to an energy transducer EW (for example as part of a transducer set) in such a way that at least some of the current, i.e. a partial conductor current, or all of the current of the first conductor L1 flows through the primary side of the energy transducer EW. Conventionally, a conductor, in the example of the first conductor L1, forms the primary side of the energy transducer EW. The energy transducer EW is conventionally a transformer with a core, for example an iron-core transformer. In one configuration, an energy transducer EW can be provided in each phase or in each conductor of the electrical circuit. The secondary side of the energy transducer EW or of each provided energy transducer is connected to a power supply unit NT (or a plurality of power supply units), which makes available an energy supply, for example an internal power supply, for example in the form of a supply voltage, for the electronic trip unit ETU, illustrated by a combination of operating voltage conductors BS illustrated by dashed lines. The power supply unit NT can also additionally be connected to at least one or all of the current sensors SE1, SE2, SE3, SEN, for supplying energy to the current sensors, if required.

Each current sensor SE1, SE2, SE3, SEN has at least one sensor element, for example a Rogowski coil, a shunt, a Hall sensor or the like, for determining the level of the electrical current in the conductor associated with it of the electrical circuit. In the example, the first current sensor SE1 is associated with the first conductor L1, i.e. the first phase; the second current sensor SE2 is associated with the second conductor L2, i.e. the second phase; the third current sensor SE3 is associated with the third conductor L3, i.e. the third phase; the fourth current sensor SEN is associated with the (fourth conductor) neutral conductor N.

The first to fourth current sensors SE1, SE2, SE3, SEN are connected to the electronic trip unit ETU and transmit the level of the electrical current of the respective conductor to the electronic trip unit.

The transmitted level of the current is compared in the electronic trip unit ETU with current limit values or/and current/time span limit values, which form the grounds for tripping. In the event that the limit values are exceeded, an interruption of the electrical circuit is initiated. Hereby, an overcurrent or/and short-circuit protection is realized. This can take place, for example, by virtue of the fact that an electromechanical switching unit EM is provided, which firstly is connected to the electronic trip unit ETU and secondly has contacts K or contact points for interrupting the conductors L1, L2, L3, N or further conductors. The electromechanical switching unit EM in this case receives an interruption signal for opening the contacts or contact points.

Figure 2:
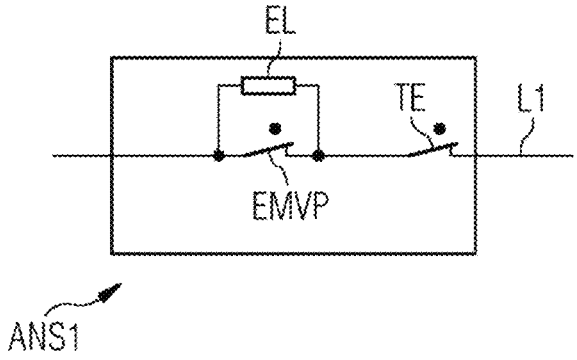
FIG. 2 shows a block circuit diagram of a first arrangement according to an embodiment of the invention.

FIG. 2 shows an arrangement ANS1 according to an embodiment of the invention, wherein the arrangement ANS1 shown in FIG. 2 is used in place of the electromechanical switching unit EM shown in FIG. 1, for example an arrangement ANS1 according to an embodiment of the invention is used in each conductor L1, L2, L3, N; in the example, four units ANS1 according to an embodiment of the invention would replace the previous electromechanical switching unit EM shown in FIG. 1.

FIG. 2 shows a conductor, for example the first conductor L1, which has a parallel circuit comprising a novel electromechanical switching unit EMVP (vacuum circuit breaker) according to an embodiment of the invention and an electronic switching unit EL. An electromechanical disconnecting unit TE, as illustrated in FIG. 2, can be connected in series with this parallel circuit (EMVP, EL). The units in the parallel circuit (EMVP, EL) and, if appropriate, the electromechanical disconnecting unit (TE) are connected to the electronic trip unit ETU or a controller of the switch in a conventional manner by connections (not illustrated).

Figure 3:
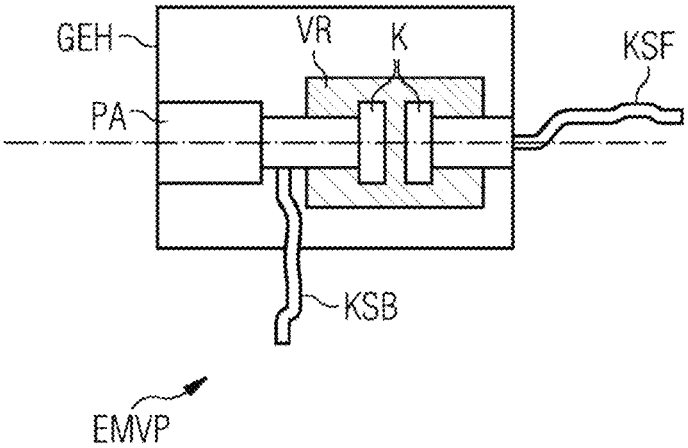
FIG. 3 shows an illustration of an electromechanical switching unit according to an embodiment of the invention.

FIG. 3 shows an illustration of a novel electromechanical switching unit EMVP or vacuum circuit breaker EMVP according to an embodiment of the invention, as they are intended to be used in FIG. 2. This can have a housing GEH. It furthermore has contacts K, specifically a fixed contact point KSF and a movable contact point KSB. Alternatively, two movable contact points can also be provided.

Both are arranged in a vacuum, for example in a vacuum interrupter VR.

The movable contact point KSB is actuated by a piezoelectric actuator PA, in particular by a piezoelectric stack, with which a large travel path/switching path can be realized, i.e. its position can be changed, with the result that, in a first switching position, the two contact points KSB, KSF are connected to one another so that an electrical current can flow, and, in a second switching position, the relevant contact points KSB, KSF are not connected to one another, i.e. are isolated, so that no electrical current can flow.

According to an embodiment of the invention, in the case of a low-voltage circuit breaker, in the event of an interruption operation first disconnection, i.e. opening or non-connection of the contacts/contact points, of the vacuum circuit breaker EMVP/novel electromechanical switching unit EMVP takes place, and then blocking, i.e. becoming nonconductive or highly resistive, of the electronic switching unit EL takes place.

In the case of a closing operation, first the electronic switching unit EL becomes conductive or weakly resistive, then the novel electromechanical switching unit EMVP or vacuum circuit breaker EMVP closes, i.e. the contacts close or the contact points are connected to one another.

If an electromechanical disconnecting unit TE is provided, it opens its contacts during an interruption operation following the nonconductive or high-resistance state of the electronic switching unit EL.

During a closing operation, first the contacts of the electromechanical disconnecting unit TE close before the electronic switching unit EL becomes weakly resistive or conductive.

Figure 4:
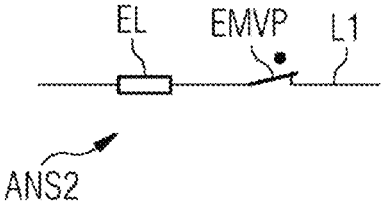
FIG. 4 shows a block circuit diagram of a second arrangement according to an embodiment of the invention.

FIG. 4 shows a second arrangement ANS2 for a low-voltage switch NS, in which the second arrangement ANS2 shown in FIG. 4 is used in place of the electromechanical switching unit EM shown in FIG. 1.

FIG. 4 shows an electronic switching unit EL, which is connected electrically in series with the novel electromechanical switching unit EMVP or vacuum circuit breaker EMVP, shown in FIG. 3.

In the case of a low-voltage switch NS with a series circuit comprising an electronic switching unit EL and a novel electromechanical switching unit EMVP, when current or/and current/time span limit values of the conductor are exceeded, first blocking of the electronic switching unit EL and then disconnection of the novel electromechanical switching unit/vacuum circuit breaker EMVP is performed.

During a closing operation, first the novel electromechanical switching unit/vacuum circuit breaker EMVP is closed, and then the electronic switching unit EL becomes conductive or weakly resistive.

The electronic switching unit EL has, in accordance with an embodiment of the invention, at least one semiconductor switching element, in particular an isolated gate bipolar transistor, IGBT for short. In a first switching state, the electronic switching unit EL is electrically conductive, i.e. has a low resistance, and in a second switching state it is electrically blocking, i.e. has a high resistance—ideally is nonconductive.

The novel electromechanical switching unit/vacuum circuit breaker EMVP for connecting at least two electrical contact points is configured, for example, in such a way that the piezoelectric actuator PA is coupled to the movable contact point KSB, with the result that the movable contact point KSB is displaceable between the first switching position and the second switching position via the piezoelectric actuator PA.

In one configuration, the vacuum circuit breaker EMPV can be embodied in such a way that a plurality of movable electrical contact points KSB are provided, which are mechanically coupled to one another in such a way that they are displaceable together between the switching positions via the piezoelectric actuator PA.

Therefore, two, three or four (or a plurality of) contacts can be opened or closed simultaneously by a piezoelectric actuator.

The advantage of an embodiment of the invention resides inter alia in a drive technology for electromechanical switching which allows a change in switching position/commutation, i.e. switchover from electromechanical current path to the electronic current path (semiconductor path), in the μs (microseconds) range. Previous known concepts are too slow. With a piezoelectric stack embodiment according to the invention, the possibility is provided of adapting both response time and travel.

The possible limitation of the travel of piezoelectric actuators is compensated for according to the invention by a vacuum interrupter, i.e. the piezoelectric drive is combined with a vacuum interrupter.

In one configuration, the piezoelectric actuator can be integrated in the vacuum interrupter or vacuum chamber.

Required isolation distances can be realized with the aid of a vacuum chamber or vacuum interrupter additionally with relatively small spacings, which is of particular advantage for low-voltage switches or possibly low-voltage circuit breakers.

The dimensioning of the vacuum chamber is dependent on the rated current. In this case, use can advantageously be made of the fact that power semiconductors in, for example, converters already limit the current. Furthermore, there is the possibility of switching from expensive semiconductor material, such as SiC, to Si, which also has a relatively high current-carrying capacity and in addition is inexpensive as IGBT.

With an electromechanical disconnecting unit TE or disconnector connected in series, a DC isolation path can be achieved.

Although the invention has been illustrated in more detail and described in detail by the example embodiment, the invention is not restricted by the disclosed examples, and other variations can be derived herefrom by a person skilled in the art without departing from the scope of protection of the invention.

The invention claimed is:

1. A low-voltage circuit breaker, comprising:

at least one current sensor, configured to determine a level of an electrical current through a conductor, associated with the at least one current sensor, of the low-voltage circuit breaker;

at least one electromechanical switching device configured to connect and disconnect at least two electrical contact points, at least one of the at least two electrical contact points being a movable contact point to be movable to, in a first switching position of the movable contact point, connect the at least two electrical contact points to one another and, in a second switching position of the movable contact point, disconnect the at least two electrical contact points from one another;

at least one electronic switching device, including a semiconductor switching element, electrically conductive in a first switching state and electrically blocking in a second switching state, the at least one electronic switching device being connected electrically in parallel with the at least one electromechanical switching device;

an electronic trip device, connected to the at least one current sensor, the at least one electronic switching device and the at least one electromechanical switching device, the electronic switching device configured to, upon at least one of current values or current/time span limit values of the conductor being exceeded, first disconnect the at least one electromechanical switching device and then block the at least one electronic switching device, the at least one electromechanical switching device being configured as a vacuum circuit breaker, with the at least two electrical contact points in a vacuum, wherein a piezoelectric actuator is provided for changing a switching position; and at least one electromechanical disconnecting device electrically connected in series with a parallel circuit including a vacuum circuit breaker and the at least one electronic switching device, wherein the at least one electromechanical disconnecting device is connected to the electronic trip device, and, upon at least one of current values or current/time span limit values of the conductor being exceeded, first disconnection of the vacuum circuit breaker takes place, then blocking of the at least one electronic switching device takes place, and then disconnection of the at least one electromechanical disconnecting device takes place, wherein the semiconductor switching element is an IGBT component based on silicon.

2. The low-voltage circuit breaker of claim 1, wherein the at least one electromechanical disconnecting device has disconnector properties.

3. A low-voltage switch, comprising:

at least one current sensor, configured to determine a level of an electrical current through a conductor, associated with the at least one current sensor, of the low-voltage switch;

at least one electromechanical switching device configured to connect and disconnect at least two electrical contact points, at least one of the at least two electrical contact points being a movable contact point configured to be movable to, in a first switching position of the movable contact point, connect the at least two electrical contact points to one another and, in a second switching position of the movable contact point, disconnect the at least two electrical contact points from one another;

at least one electronic switching device, including a semiconductor switching element, electrically conductive in a first switching state and electrically blocking in a second switching state, the at least one electronic switching device being connected electrically in series with the at least one electromechanical switching device; and an electronic trip device, connected to the at least one current sensor, the at least one electronic switching device and the at least one electromechanical switching device, the electronic trip device being configured to, upon at least one of current values or current/time span limit values of the conductor being exceeded, first blocking the at least one electronic switching device and then disconnecting the at least one electromechanical switching device;

wherein the at least one electromechanical switching device is configured as a vacuum circuit breaker, in which the at least two electrical contact points are in the vacuum, and wherein a piezoelectric actuator is provided for changing a switching position, and wherein the semiconductor switching element is an IGBT based on silicon.

4. The low-voltage switch of claim 3, wherein the piezoelectric actuator is a piezoelectric stack.

5. The low-voltage switch of claim 4, wherein the semiconductor switching element is a component based on silicon.

6. The low-voltage switch of claim 5, wherein the semiconductor switching element is an IGBT.

7. The low-voltage switch of claim 4, wherein the low-voltage switch is provided for a low-voltage circuit, and the vacuum circuit breaker and an electronic switching unit are provided for each of the conductors, monitored by the switch of the low-voltage circuit.

8. The low-voltage switch of claim 3, wherein the low-voltage switch is provided for a low-voltage circuit, and the vacuum circuit breaker and the electronic switching device are provided for each of the conductors, monitored by the low-voltage switch of the low-voltage circuit.

* * * * *